US011892257B2

(12) United States Patent
Abrams et al.

(10) Patent No.: US 11,892,257 B2
(45) Date of Patent: Feb. 6, 2024

(54) RETAINING DEVICES FOR FIREARM BOLTS AND FIREARMS INCLUDING SAME

(71) Applicant: Abrams Airborne Manufacturing, Inc., Tucson, AZ (US)

(72) Inventors: Gary L. Abrams, Tucson, AZ (US); Brandon L. Waddel, Tucson, AZ (US); Cody A. Jensen, Tucson, AZ (US)

(73) Assignee: Abrams Airborne Manufacturing, Inc., Tucson, AZ (US)

( * ) Notice: Subject to any disclaimer, the term of this patent is extended or adjusted under 35 U.S.C. 154(b) by 0 days.

(21) Appl. No.: 17/824,578

(22) Filed: May 25, 2022

(65) Prior Publication Data

US 2022/0381529 A1 Dec. 1, 2022

Related U.S. Application Data

(60) Provisional application No. 63/194,655, filed on May 28, 2021.

(51) Int. Cl.
*F41A 17/42* (2006.01)
*F41A 5/18* (2006.01)
*F41A 3/26* (2006.01)

(52) U.S. Cl.
CPC ..... *F41A 17/42* (2013.01); *F41A 3/26* (2013.01); *F41A 5/18* (2013.01)

(58) Field of Classification Search
CPC ..... F41A 17/42
See application file for complete search history.

(56) References Cited

U.S. PATENT DOCUMENTS

| | | | | |
|---|---|---|---|---|
| 4,471,551 | A * | 9/1984 | Mattarelli | F41A 17/32 42/70.01 |
| 5,608,981 | A * | 3/1997 | Canaday | F41A 15/16 42/25 |
| 6,260,298 | B1 * | 7/2001 | Bubits | F41A 17/64 42/70.11 |
| 8,082,833 | B1 * | 12/2011 | Hardin | F41A 17/42 89/1.4 |
| 2002/0020099 | A1 * | 2/2002 | Silveira | F41A 17/64 42/70.08 |
| 2019/0285373 | A1 * | 9/2019 | Palkow | F41A 19/16 |

FOREIGN PATENT DOCUMENTS

| | | | | |
|---|---|---|---|---|
| DE | 29906886 U1 * | 6/1999 | | F41A 17/64 |

* cited by examiner

*Primary Examiner* — Jonathan C Weber
(74) *Attorney, Agent, or Firm* — Dugan Law Office, LLC

(57) ABSTRACT

Retaining devices securable on firearms are selectively operable to engage and retain a bolt assembly in a substantially-fixed position for an indeterminate period of time. The retaining devices include a mounting plate securable to the receiver and a retention pin that extends through a passage in the mounting plate. The retention pin extends axially between first and second ends that project outwardly beyond the mounting plate. The retention pin is supported on the mounting plate for axial displacement between a first pin position and a second pin position. In the first pin position, the second end of the retention pin engages and retains the bolt assembly in a substantially-fixed position relative to the receiver. In the second pin position, the second end of the retention pin is disengaged from the bolt assembly.

20 Claims, 8 Drawing Sheets

RETAINING DEVICES FOR FIREARM BOLTS AND FIREARMS INCLUDING SAME

This application claims the benefit of priority to U.S. Provisional Patent Application Ser. No. 63/194,655, filed on May 28, 2021, which is hereby incorporated herein by reference in its entirety.

BACKGROUND

The subject matter of the present disclosure broadly relates to the art of firearms and, more particularly, to devices that are selectively operable to engage a firearm bolt or bolt assembly and retain the firearm bolt or bolt assembly in a predetermined (e.g., open) position. It will be appreciated that such devices may be used in connection with an action of automatic and semi-automatic weapons, such as M2 series machine guns, for example. Firearms including such retaining devices are also included.

The subject matter of the present disclosure may find particular application and use in conjunction with automatic and semi-automatic firearms, such as M2 series machine guns, for example, and will be shown and described herein with reference thereto. It is to be appreciated and understood, however, that the subject matter of the present disclosure is also amenable to use in connection with firearms of other types and kinds, and that the specific references shown and described herein are merely exemplary.

Automatic and semi-automatic weapons commonly include a bolt or bolt assembly that cycles forwards and backwards as the weapon is fired. In some cases, known automatic and semi-automatic firearms operate using so-called "open bolt" designs in which the bolt is retained in a rearward or open position prior to firing. As the trigger is displaced, the firearm bolt travels forward, which chambers a round of ammunition and discharges the firearm through contact of a firing pin with the chambered round of ammunition. In other cases, known automatic and semi-automatic firearms operate using a co-called "closed-bolt" designs in which a round of ammunition is chamber and the bolt is moved into a forward or closed position prior to firing. It will be recognized and understood that operating automatic and semi-automatic firearms are designed and constructed for use at rapid discharge rates. Such use and/or operation typically generates a substantially amount of excess heat and the temperature of many components of the firearm increase significantly.

Generally, it is believed that firearms with open-bolt designs dissipate heat more effectively and, as such, operate at somewhat lower overall temperatures for a given firing rate. Additionally, a round of ammunition is chambered immediately prior to being discharged in firearms having an open-bolt design. As such, minimal opportunity exists with firearms that have an open-bolt design for thermal detonation of the round (i.e., a so-called "cook-off") while the round is in the chamber but prior to intentional discharge of the firearm.

It is generally believed that firearms with closed-bolt designs may operate with increased accuracy in comparison with firearms having an open-bolt design. However, closed-bolt firearms are often considered to dissipate heat less effectively and, as such, may have certain components that operate at higher overall temperatures than those in comparable open-bolt firearms. Additionally, rounds of ammunition may be chambered with the bolt in the forward or closed position for greater periods of time in closed-bolt firearms than in with firearms of an open-bolt design. As such, in some conditions of use, it may be desirable to selectively retain the bolt of closed-bolt firearms in a rearward or open position for an indeterminate period of time (e.g., second and/or minutes), such as may be used to minimize or at least reduce the chance of a premature thermal detonation, for example. In many of such circumstances, the bolt is simply held open manually or retained in position by straps, cords or other improvised devices.

As such, notwithstanding the ubiquity and common usage of known automatic and semi-automatic firearms, the foregoing and/or other disadvantages still exist that remain to be addressed. Accordingly, it is believed desirable to develop devices that overcome the foregoing and/or other problems and/or disadvantages of known designs, and/or otherwise advance the art of firearms.

BRIEF DESCRIPTION

One example of a retaining device in accordance with the subject matter of the present disclosure is securable along an associated firearm and selectively operable to engage and retain an associated bolt assembly of the associated firearm in a substantially-fixed position for an indeterminate period of time. The retaining device can include a mounting plate dimensioned for securement on an associated receiver of the associated firearm at an associated distance from the associated bolt assembly. The mounting plate can include a first side surface portion, a second side surface portion facing opposite the first side surface portion and a pin-receiving passage extending through the mounting plate. The mounting plate has a height, a length and a width with the first and second side surface portions spaced apart from one another in a heightwise direction. A retention pin has a longitudinal axis and extends axially from a first end toward a second end. The retention pin extends through the pin-receiving passage such that the first end projects outwardly from the mounting plate beyond the first side surface portion and the second end projects outwardly from the mounting plate beyond the second side surface portion. The retention pin is supported on the mounting plate for axial displacement relative thereto between a first pin position and a second pin position. In the first pin position, the second end of the retention pin extends outwardly from the mounting plate a first distance that is greater than the associated distance from the associated bolt assembly such that in the first pin position the second end of the retention pin can engage the associated bolt assembly to retain the associated bolt assembly in a substantially-fixed (e.g., open) position relative to the associated receiver. In the second pin position, the second end of the retention pin extends outward from the mounting plate a second distance that is less than the associated distance from the associated bolt assembly such that in the second pin position the second end of the retention pin is disengaged from the associated bolt assembly.

Another example of a retaining device in accordance with the subject matter of the present disclosure is securable along an associated firearm and selectively operable to engage and retain an associated bolt assembly of the associated firearm in a substantially-fixed (e.g., open) position for an indeterminate period of time. The retaining device can include a mounting plate dimensioned for securement on an associated receiver of the associated firearm at an associated distance from the associated bolt assembly. The mounting plate has a height, a width and a length. The mounting plate can include a mounting plate wall with a base wall portion and a projection wall portion. The base wall portion can include a first side surface portion and a second side surface portion spaced apart from the first side surface portion in a heightwise direction. The projection wall portion can extend from the base wall portion in the heightwise direction toward an end surface portion. First and second pin-receiving passages can extend through the base wall portion and the projection wall portion of the mounting plate wall with the second pin-receiving passage spaced from the first pin-receiving passage in a lengthwise direction. A securement passage can extend through the base wall portion with the securement passage spaced from the first and second pin-receiving passages in a widthwise direction. A retention pin has a longitudinal axis and extends axially from a first end toward a second end. The retention pin extends through one of the first and second pin-receiving passages such that the first end projects outwardly from the mounting plate beyond the end surface portion and the second end projects outwardly from the mounting plate beyond the second side surface portion. The retention pin is slidably supported on the mounting plate for axial displacement relative thereto. A securement device extends through the securement passage and is dimensioned for engagement with the associated receiver. An operator-actuation device can be secured on the first end of the retention pin, and a spring can be compressively disposed between the mounting plate and the operator-actuation device. The operator-actuation device and the spring can be cooperative to provide for axial displacement of the retention pin between a first pin position and a second pin position. In the first pin position, the second end of the retention pin extends outwardly from the mounting plate a first distance that is greater than the associated distance from the associated bolt assembly such that in the first pin position the second end of the retention pin is dimensioned to engage the associated bolt assembly and retain the associated bolt assembly in a substantially-fixed (e.g., open) position relative to the associated receiver. In the second pin position, the second end of the retention pin extends outward from the mounting plate a second distance that is less than the associated distance from the associated bolt assembly such that in the second pin position the second end of the retention pin is disengaged from the associated bolt assembly.

One example of a firearm in accordance with the subject matter of the present disclosure can include a receiver extending in a longitudinal direction from a forward end toward a rearward end. The receiver can include a receiver wall at least partially defining a receiver chamber. The receiver wall can include a side wall portion with an elongated slot oriented longitudinally therealong and extending therethrough such that the elongated slot is in communication with the receiver chamber. A bolt assembly can be at least partially disposed within the receiver chamber and can be supported for reciprocal displacement in the longitudinal direction between the forward end and the rearward end of the receiver. A retaining device is secured on the receiver wall. The retaining device includes a mounting plate disposed along the side wall portion of the receiver wall, and a retention pin oriented in a lateral direction transverse to the longitudinal direction. The retention pin is supported on the mounting plate for displacement in the lateral direction between a first pin position and a second pin position. In the first pin position, the retention pin extends through the elongated slot into engagement with the bolt assembly such that the bolt assembly is retained in a substantially-fixed longitudinal position (e.g., an open position) within the receiver chamber. In the second pin position, the retention pin is retracted from engagement with the bolt assembly such that the bolt assembly is reciprocally displaceable within the receiver chamber in the longitudinal direction.

DETAILED DESCRIPTION

Figure 1:
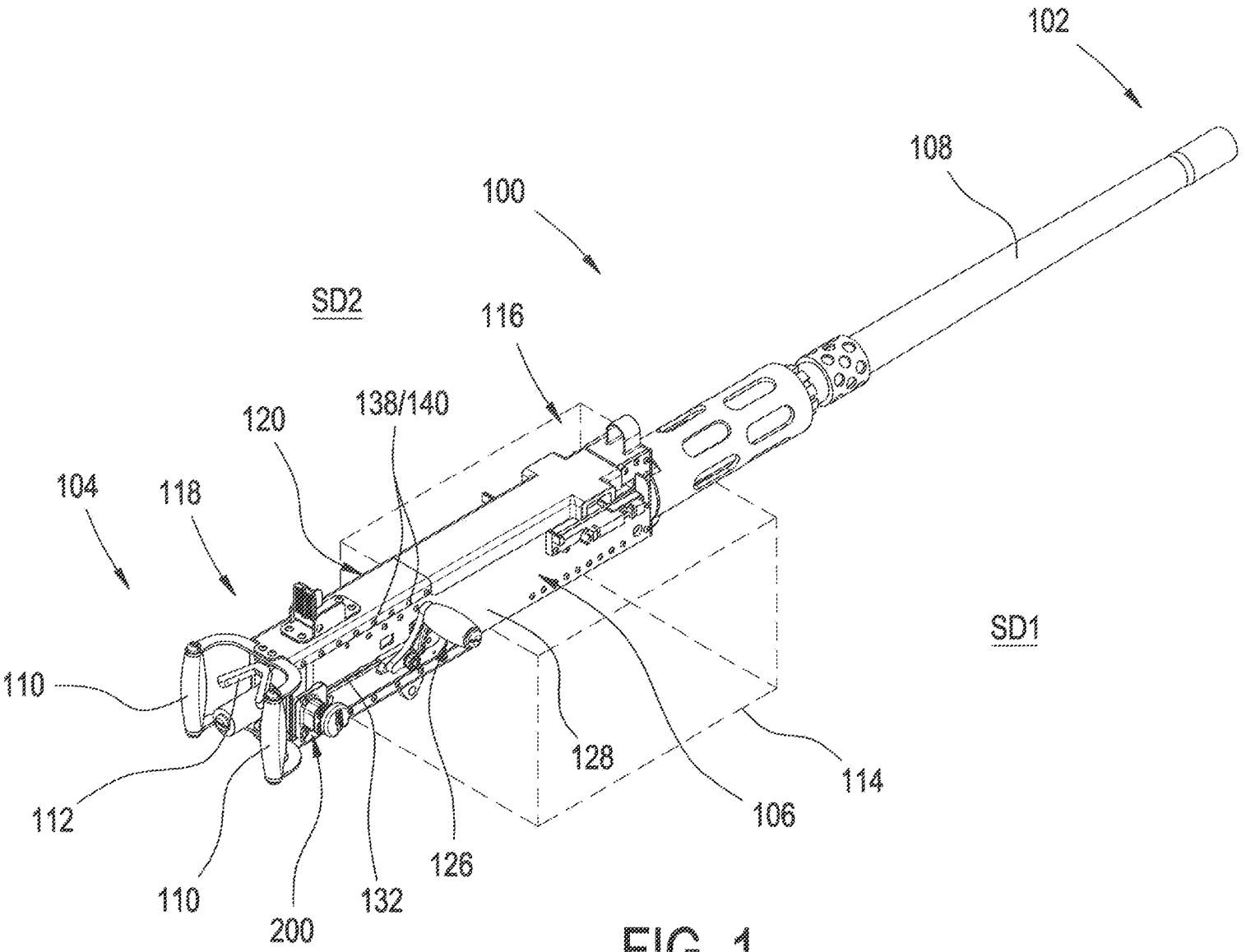
FIG. 1 is a top perspective view of an exemplary firearm including a retaining device in accordance with the subject matter of the present disclosure.

Turning now to the drawings, it is to be understood that the showings are for purposes of illustrating examples of the subject matter of the present disclosure and are not intended to be limiting. Additionally, it will be appreciated that the drawings are not to scale and that portions of certain features and/or elements may be exaggerated for purpose of clarity and ease of understanding.

FIGS. 1-5 illustrate one example of a firearm 100 in accordance with the subject matter of the present disclosure. Firearm 100 extends longitudinally from an end 102 toward an end 104. End 102 represents the area of the firearm from which a bullet or other projectile is discharged toward an associated target during use in operation. End 104 represents the area of the firearm from which an operator aims and selectively discharges the firearm. Firearm 100 can include a receiver 106 on or along which other components of the firearm can be mounted or otherwise operatively attached. For example, a barrel 108 extends longitudinally from receiver 106 toward end 102 of the firearm. As other example, hand grips 110 and/or a trigger 112 can be supported on receiver 106 and accessible from along end 104 of the firearm.

As discussed above, it will be recognized that the subject matter of the present disclosure may find particular application and use in conjunction with automatic and semi-automatic firearms, such as M2 series machine guns, for example, and will be shown and described herein with reference thereto. It is to be appreciated and understood, however, that the subject matter of the present disclosure is also amenable to use in connection with firearms of other types and kinds, and that the specific references shown and described herein are merely exemplary. As such, it will be appreciated that firearm 100 can, in some cases, be handheld or otherwise manually carried during use in operation. In other cases, firearm 100 can include a portable folding mount (e.g., bipod or tripod legs) and/or can be moveably supported on a fixed or stationary mount (e.g., turrets, ring mounts, sling mounts), such as may permit securement of the firearm on or along land vehicles, aircraft and/or watercraft, for example. Any and all of which mounts and/or other support devices are collectively represented in FIGS. 1-3 by box 114.

Firearm 100 has opposing sides SD1 and SD2 with a midline MDL extending longitudinally therealong the firearm between the opposing sides. Receiver 106 extends longitudinally from a receiver end 116 disposed toward end 102 to a receiver end 118 disposed toward end 104 of the firearm. Receiver 106 includes a receiver wall 120 that at least partially defines a receiver chamber 122. A bolt assembly 124 is at least partially received within receiver chamber 122 and is supported on or along the receiver for reciprocal operation in the longitudinal direction (e.g., between receiver ends 116 and 118). Generally, bolt assembly 124 translates or is otherwise displaced longitudinally during operation of firearm 100 between a forward or closed position, which is represented by position CLD, and a rearward or open position, which is represented by position OPN. It will be recognized and appreciated that bolt assembly 124 is disposed toward receiver end 116 in the closed position and that bolt assembly 124 is disposed toward receiver end 118 in the open position. As bolt assembly 124 reciprocates between the open and closed positions, a cartridge or round of ammunition RAM is loaded into a firing chamber at least partially formed by receiver 106 and/or barrel 108 as the bolt assembly moves in the forward direction (i.e., toward receiver end 116), such as is well understood in connection with known firearm constructions.

Figure 2:
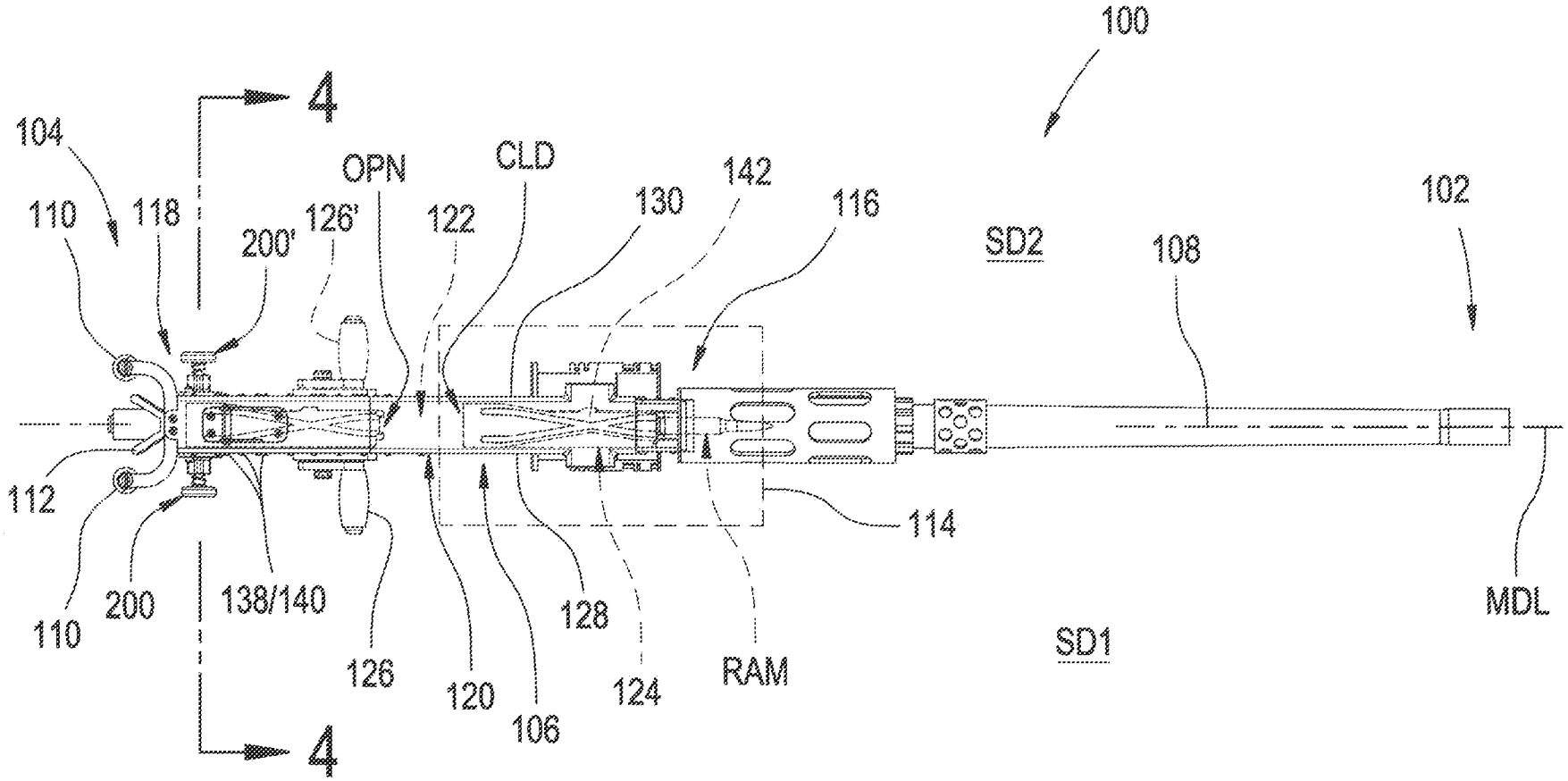
FIG. 2 is a top plan view of the exemplary firearm in FIG. 1.
Figure 3:
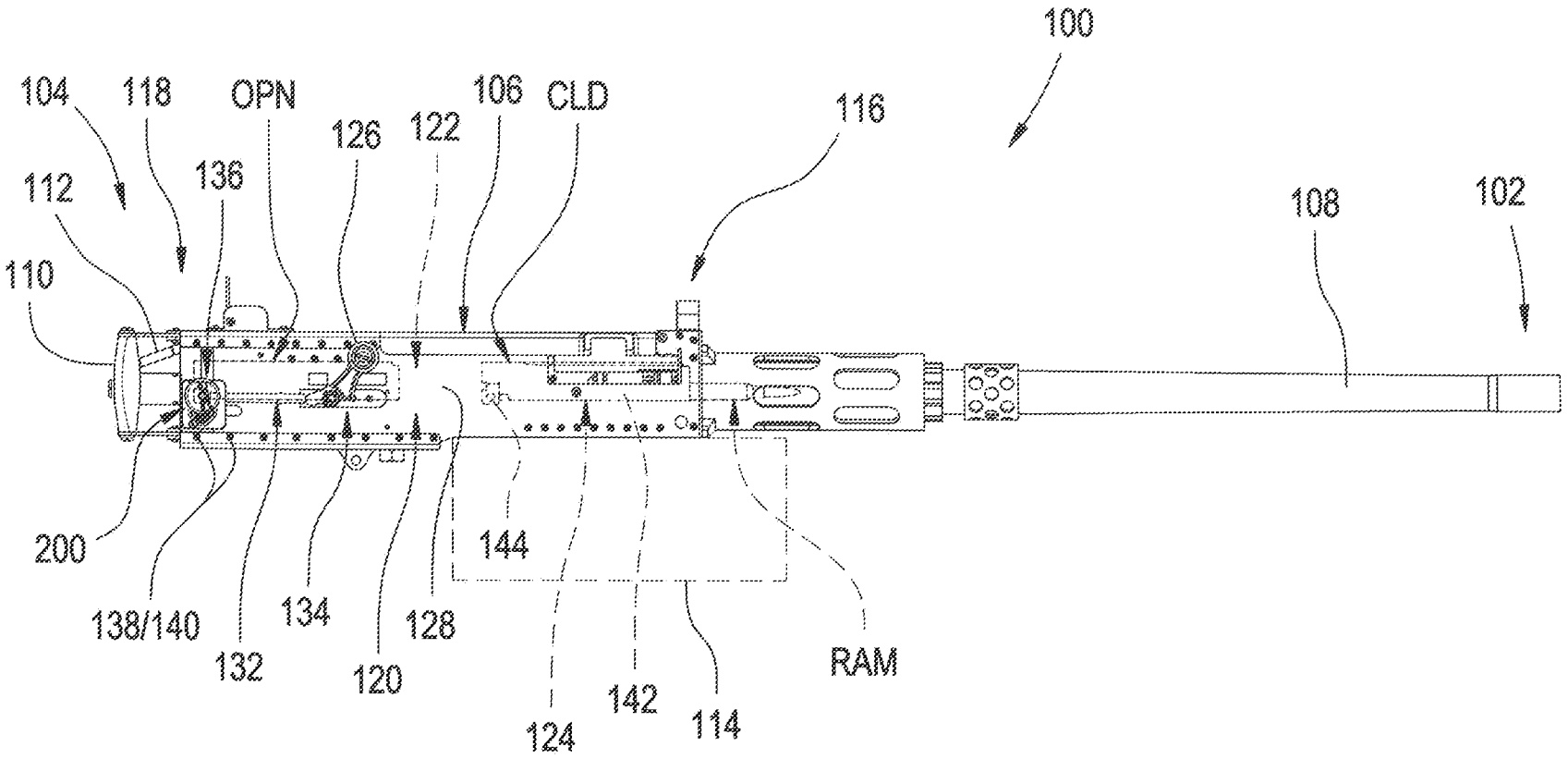
FIG. 3 is a side elevation view of the exemplary firearm in FIGS. 1 and 2.

In some cases and/or under certain conditions of use, it may be desirable to retract or otherwise manually displace bolt assembly 124 from closed position CLD toward open position OPN. As such, firearm 100 can include a retraction handle 126 operatively engaged with receiver 106 and/or bolt assembly 124, which can be manually manipulated by an operator to retract or otherwise move bolt assembly 124 from closed position CLD toward open position OPN. It will be appreciated that firearms are commonly capable of being setup for either left-handed or right-handed operation. As such, retraction handle 126 can be operatively engaged with receiver 106 and/or bolt assembly 124 from along side SD1, such as is shown in FIGS. 1-3 or from along side SD2, such as is represented by retraction handle 126' in FIG. 2.

Receiver wall 120 includes a side wall portion 128 disposed along side SD1 and a side wall portion 130 disposed along side SD2 of firearm 100. Receiver chamber 128 is generally defined in a lateral direction between side wall portions 128 and 130 and longitudinally between receiver ends 116 and 118. Either one or both of side wall portions 128 and/or 130 can include an elongated slot 132 extending longitudinally from a forward slot end 134 to a rearward slot end 136. Side wall portions 128 and/or 130 can be secured together or otherwise attached to one or more other components of receiver 106 in a suitable manner, such as by way of securement devices 138 (e.g., threaded fasteners) engaging corresponding securement devices 140 (e.g., threaded holes) of receiver wall 120.

Bolt assembly 124 can include any one or more of a variety of components and elements that operate to cycle the firearm and discharge one or more bullets during use. On automatic and semi-automatic weapons, the bolt assembly will commonly load rounds of ammunition, lock the firing chamber, fire the ammunition as well as extract and eject the spent ammunition casing. As non-limiting examples, bolt assembly 124 can include any one or more of a bolt, a firing pin, and/or an extractor any one or more of which can be included as a part of or otherwise supported on a bolt carrier 142. As such, it will be appreciated that bolt carrier 142 can include any one or more of a variety of components and/or features, such as a carrier passage 144 that extends laterally through the bolt carrier. Bolt assembly 124 also includes a driving spring 146 that is operatively engaged with bolt carrier 142 and urges the bolt carrier toward forward or closed position CLD. In a preferred arrangement, carrier passage 144 can be at least approximately aligned with and accessible through elongated slot 132 such that carrier passage 144 is accessible through side wall portion 128 and/or 130 when bolt assembly 124 is in or near open position OPN. In other cases, however, side wall portions 128 and/or 130 can include a separate opening with which the carrier passage can be at least approximately aligned when in or near the open position of the bolt assembly such that the carrier passage is accessible through one or more of the side wall portions.

As discussed above, it has been determined that under some circumstances or conditions of use of certain firearms, such as so-called "closed bolt" firearms, for example, it may be desirable to retract or otherwise move the bolt assembly into a rearward or open position and maintain the bolt assembly in such a rearward or open position for an indeterminant period of time (e.g., seconds or minutes). As such, firearms in accordance with the subject matter of the present disclosure (e.g., firearm 100) include a retaining device that is selectively operable to engage a bolt or bolt assembly and maintain the bolt or bolt assembly in a substantially-fixed position (e.g., open position) for an indefinite period of time, such as may be desired or otherwise determined by the operator as being an appropriate period of time. At which point, the operator can deactivate or otherwise disengage the retaining device from the bolt or bolt assembly thereby permitting the bolt or bolt assembly to travel forward toward a closed position.

One example of a retaining device 200 in accordance with the subject matter of the present disclosure is shown in FIGS. 1-5 as being supported on or along receiver 106 of firearm 100 and adapted for selective engagement with bolt assembly 124. As discussed above, it will be appreciated that firearms are commonly capable of being setup for either left-handed or right-handed operation. As such, a retaining device in accordance with the subject matter of the present disclosure can be operatively engaged with receiver 106 and/or bolt assembly 124 from along side SD1, such as is shown in FIGS. 1-5 or from along side SD2, such as is represented by retaining device 200' in FIG. 2, for example.

As shown in FIGS. 1-8, retaining device 200 includes a mounting plate 202 that is secured on or along receiver 106. Mounting plate 202 can be manufactured in any suitable manner from any suitable material or combination of materials, and can include any suitable number of walls and/or wall portions as well as any suitable number of surfaces and/or surface portions. For purposes of discussion and ease of understanding but without operating as a limitation, mounting plate 202 is designated as having a length and lengthwise direction represented in FIG. 8 by arrow LTH, a width and widthwise direction represented by arrow WTH as well as a height and heightwise direction represented by arrow HTH with each direction oriented transverse to the other two in an otherwise conventional (e.g., Cartesian) coordinate system.

Mounting plate 202 can include a mounting plate wall 204 that includes a surface portion 206 and a surface portion 208 facing opposite surface portion 206. Mounting plate wall 204 can include a base wall portion 210. Additionally, or in the alternative, mounting plate wall 204 can include a projection wall portion 212. In the exemplary arrangement shown in FIGS. 1-8, mounting plate wall 204 includes base wall portion 210 disposed between surface portions 206 and 208. Mounting plate wall 204 also includes projection wall portion 212 extending outwardly from along base wall portion 210 to a surface portion 214 that is spaced apart from surface portion 206 in a heightwise direction opposite surface portion 208. In some cases, mounting plate wall 204 can, optionally, include a surface portion 216 that is offset from surface portion 206 in the same heightwise direction but at a greater distance than surface portion 208 such that a shoulder surface portion 218 extends between and/or otherwise operatively connects surface portions 208 and 216. One or more securement passages 220 can extend through base wall portion 210 of mounting plate wall 204. If two or more securement passages 220 are included, the same can be spaced apart from one another in any suitable arrangement in the lengthwise direction, widthwise direction or any linear or curvilinear arrangement, such as may be complementary with corresponding ones of securement devices 140, for example. In a preferred arrangement, one or more of securement passages 220 will at least partially align with a corresponding one or more of securement devices 140 (e.g., threaded holes). In which cases, retaining device 200 can include one or more securement devices 222, such as threaded fasteners, for example, that cooperatively engage securement devices 140 to secure mounting plate 202 on or along receiver 106.

Mounting plate 202 also includes at least one pin-receiving passage extending therethrough in the heightwise direction. In a preferred arrangement, mounting plate 202 can include at least two pin-receiving passages, such as are identified by reference numbers 224 and 226, for example. In such an arrangement, pin-receiving passages 224 and 226 can be positioned on or along the mounting plate relative to securement passages 220 such that mounting plate 202 can be mounted on either one of sides SD1 and SD2 with at least one of pin-receiving passages 224 and 226 positioned in at least approximate alignment with elongated slot 132 of side wall portions 128 and/or 130 of receiver 106. In some cases, a groove 228 can, optionally, extend into projection wall portion 212 from along surface portion 214 and annularly around pin-receiving passages 224 and/or 226. Additionally, or in the alternative, pin-receiving passages 224 and/or 226 can, optionally, include a counterbore 230 extending into mounting plate wall 204, such as from along surface portion 208, for example, that has/have a greater cross-sectional dimension than the pin-receiving passages.

Retaining device 200 is also shown in FIGS. 1-8 as including a retention pin 232 that has a longitudinal axis AX and extends axially from an end 234 to an end 236. Retention pin 232 includes an attachment portion 238 disposed along end 234 and an engagement portion 240 disposed along end 236 with a sliding portion 242 disposed between attachment portion 238 and engagement portion 240. An operator-actuation device 244, such as knob or handle, can be secured on or along attachment portion 238 in a suitable manner, such as by way of one or more helical threads 246 cooperatively disposed on or along attachment portion 238 and/or operator-actuation device 244 and/or by way of one or more securement devices 248 (e.g. cotter pin, roll pin) extending through or otherwise operatively engaging a corresponding securement feature 250 (e.g., a cross-drilled hole) on or along attachment portion 238, for example. Additionally, or in the alternative, an annular groove 252 can extend radially into retention pin 232, such as between attachment portion 238 and sliding portion 242. If included, annular groove 252 can be dimensioned to receivingly engage a securement device 254 (e.g., retaining ring), such as may be used to capture operator-actuation device 244 in an axial direction toward engagement portion 240, for example.

Figure 4:
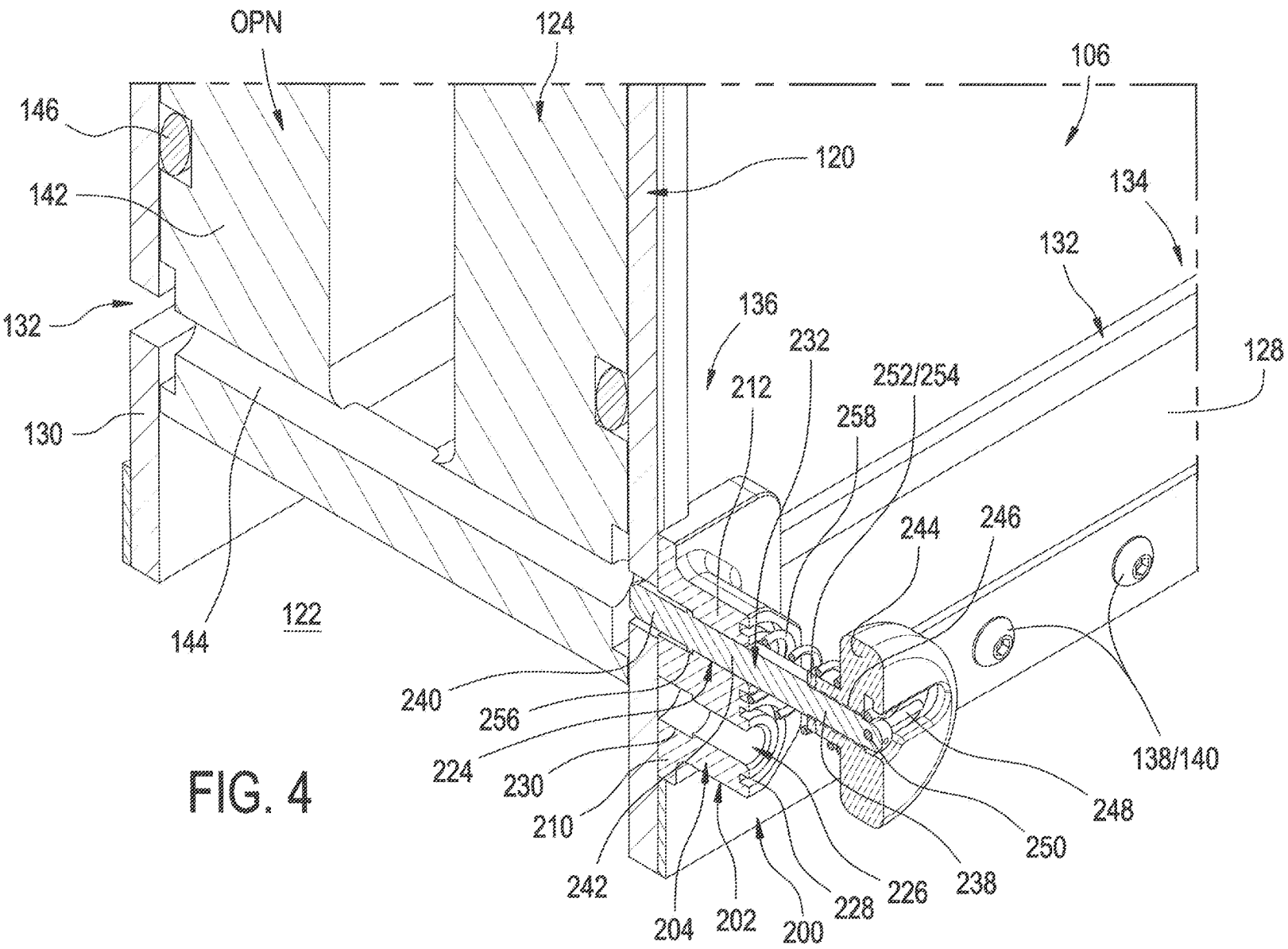
FIG. 4 is a cross-sectional view of a portion of the exemplary firearm in FIGS. 1-3 taken from along line 4-4 in FIG. 3 with the retaining device disengaged from the bolt assembly of the exemplary firearm.
Figure 5:
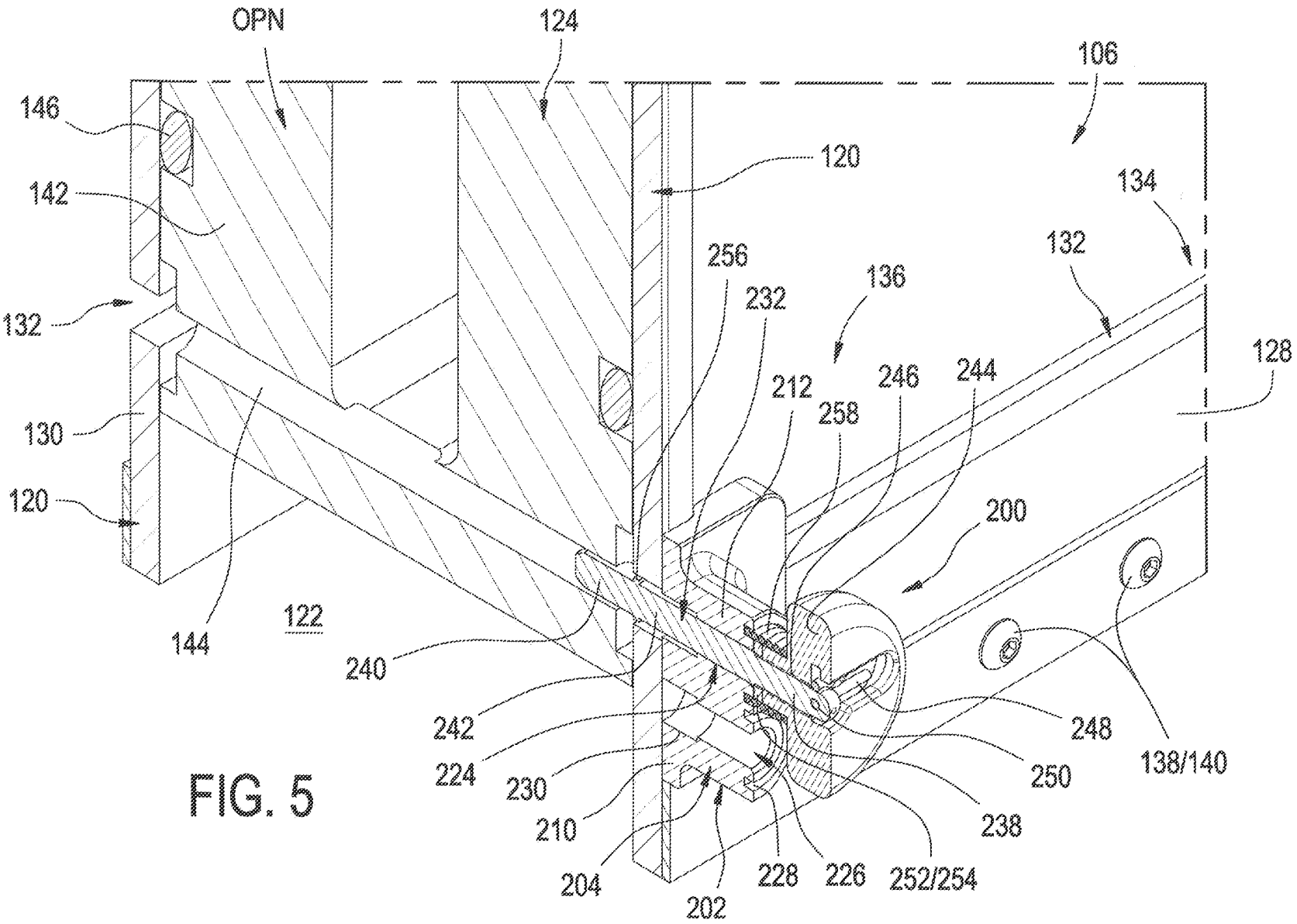
FIG. 5 is the cross-sectional view of the exemplary firearm in FIG. 4 with the retaining device engaged with and retaining the bolt assembly in a predetermined, stationary position.
Figure 6:
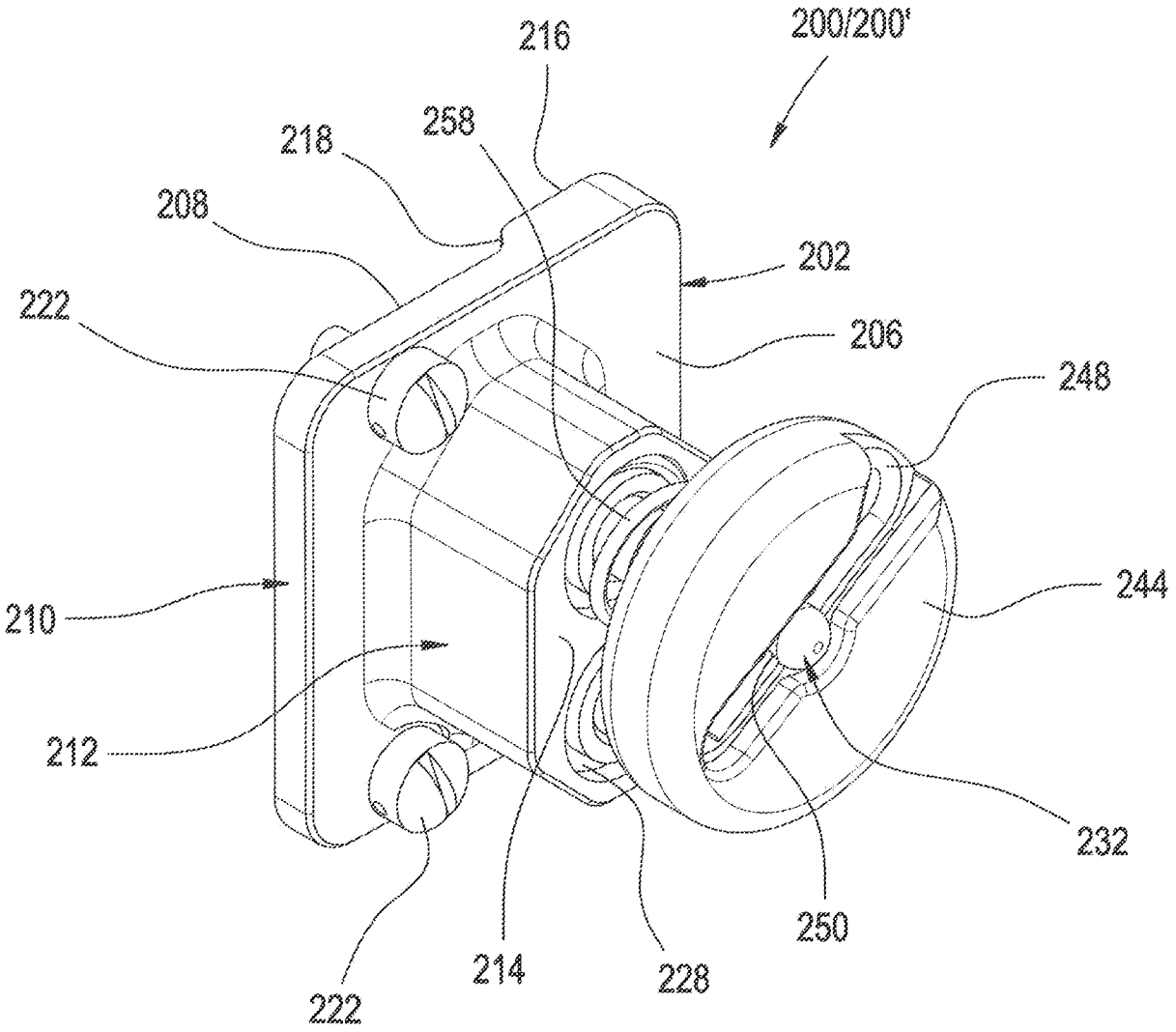
FIG. 6 is a front perspective view of the retaining device in FIGS. 1-5.
Figure 7:
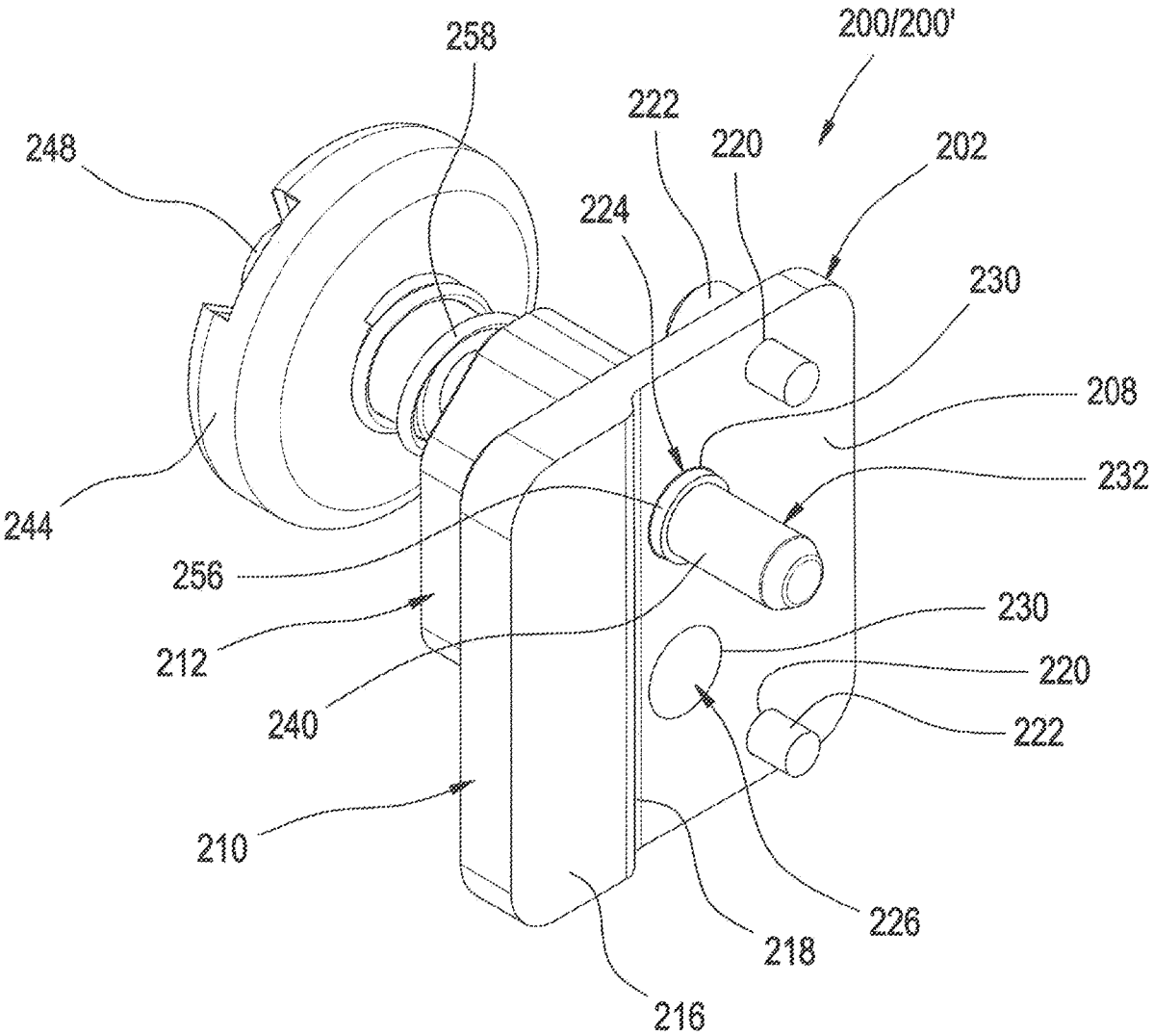
FIG. 7 is a rear perspective view of the retaining device in FIGS. 1-6.
Figure 8:
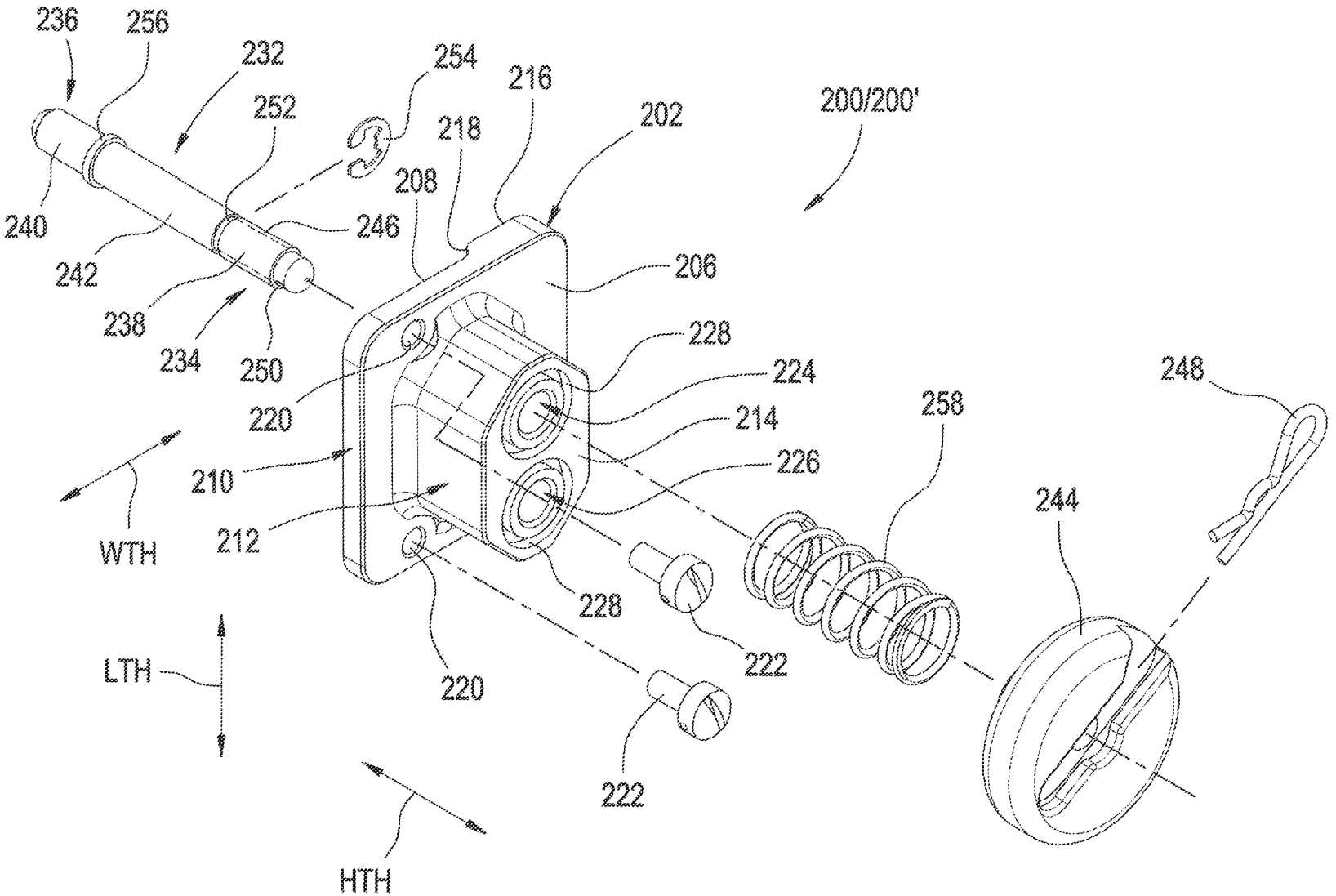
FIG. 8 is an exploded view of the retaining device in FIGS. 1-7.

Engagement portion 240 is dimensioned to cooperatively engage bolt assembly 124, such as, for example, by extending at least partially into carrier passage 144 or another such feature of bolt carrier 142 in an engaged condition of retaining device 200, such as is shown in FIG. 5, for example. In some cases, retention pin 232 can include an annular shoulder portion 256 that extends radially outward beyond at least sliding portion 242. If included, annular shoulder portion 256 can be received within counterbore 230 of mounting plate wall 204 in a disengaged condition of retaining device 200, such as is shown in FIG. 4, for example. A spring 258 can be operatively disposed between mounting plate 202 and retention pin 232, and can be operative to urge retention pin 232 in an axial direction (i.e., heightwise) away from receiver chamber 122 and/or bolt assembly 124. It will be appreciated that spring 258 can be operatively disposed between mounting plate 202 and retention pin 232 in any suitable manner, such as by abuttingly engaging projection wall portion 212 within groove 228 and/or abuttingly engaging operator-actuation device 244, for example.

It will be appreciated that sliding portion 242 of retention pin 232 is dimensioned to form a sliding fit with pin-receiving passages 224 and 226. As such, retention pin 232 translates or otherwise moves axially toward and away from receiver chamber 122 by sliding through one of pin-receiving passages 224 and 226 and thereby transitioning retaining device 200 between the disengaged condition and the engaged condition. As discussed above, in the disengaged condition of retaining device 200, retention pin 232 is retracted or otherwise displaced in an axial (i.e., heightwise) direction from engagement with bolt assembly 124. In the disengaged condition, engagement portion 240 can, in some cases, be retracted from receiver chamber 122 and positioned substantially-entirely within elongated slot 132 and/or counterbore 230. In such a disengaged condition, bolt assembly 124 is operable to cycle between open position OPN and closed position CLD, such as is understood in connection with conventional operation of firearm 100.

In an engaged condition of retaining device 200 with bolt assembly 124, such as is shown in FIG. 5, for example, retention pin 232 translates or otherwise moves axially toward receiver chamber 122 such that engagement portion 240 operatively engages bolt assembly 124 or a component thereof (e.g., bolt carrier 142) when bolt assembly 124 is in open position OPN. Driving spring 146 urges bolt assembly 124 forward (i.e., toward closed position CLD) such that frictional engagement between engagement portion 240 and bolt carrier passage 144 or another feature of bolt carrier 142 is sufficient to overcome the axial biasing force of spring 258 acting to retract retention pin 232 from engagement with the bolt assembly. Relieving the pressure from driving spring 146 of bolt carrier 142 on engagement portion 240, such as by an operator manually applying rearward pressure to the bolt assembly through retraction handle 126/126', for example, reduces the friction force therebetween such that the axial biasing force of spring 258 urges retention pin axially outward and into the disengaged condition of retaining device 200.

As used herein with reference to certain features, elements, components and/or structures, numerical ordinals (e.g., first, second, third, fourth, etc.) may be used to denote different singles of a plurality or otherwise identify certain features, elements, components and/or structures, and do not imply any order or sequence unless specifically defined by the claim language. Additionally, the terms "transverse," and the like, are to be broadly interpreted. As such, the terms "transverse," and the like, can include a wide range of relative angular orientations that include, but are not limited to, an approximately perpendicular angular orientation. Also, the terms "circumferential," "circumferentially," and the like, are to be broadly interpreted and can include, but are not limited to circular shapes and/or configurations. In this regard, the terms "circumferential," "circumferentially," and the like, can be synonymous with terms such as "peripheral," "peripherally," and the like.

Furthermore, it is to be recognized and appreciated that terms such as "can", "may", "might" and the like are to be interpreted as being permissive rather than required. As such, any reference to items with which terms such as "can", "may", "might" and the like are used shall be interpreted as being optional rather than required by the subject matter of the present disclosure unless otherwise specifically set forth herein.

It will be recognized that numerous different features and/or components are presented in the embodiments shown and described herein, and that no one embodiment may be specifically shown and described as including all such features and components. As such, it is to be understood that the subject matter of the present disclosure is intended to encompass any and all combinations of the different features and components that are shown and described herein, and, without limitation, that any suitable arrangement of features and components, in any combination, can be used. Thus it is to be distinctly understood claims directed to any such combination of features and/or components, whether or not specifically embodied herein, are intended to find support in the present disclosure. To aid the Patent Office and any readers of this application and any resulting patent in interpreting the claims appended hereto, Applicant does not intend any of the appended claims or any claim elements to invoke 35 U.S.C. 112(f) unless the words "means for" or "step for" are explicitly used in the particular claim.

Thus, while the subject matter of the present disclosure has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles hereof. Obviously, modifications and alterations will occur to others upon reading and understanding the preceding detailed description. Accordingly, it is to be distinctly understood that the foregoing descriptive matter is to be interpreted merely as illustrative of the subject matter of the present disclosure and not as a limitation. As such, it is intended that the subject matter of the present disclosure be construed as including all such modifications and alterations.

The invention claimed is:

1. A firearm comprising:

a receiver extending in a longitudinal direction from a forward end toward a rearward end, said receiver including a receiver wall at least partially defining a receiver chamber, said receiver wall including a side wall portion with an elongated slot oriented longitudinally therealong and extending therethrough such that said elongated slot is in communication with said receiver chamber;

a bolt assembly at least partially disposed within said receiver chamber and supported for reciprocal displacement in said longitudinal direction between said forward end and said rearward end of said receiver, said bolt assembly including a bolt carrier with a carrier passage extending therethrough in a lateral direction transverse to said longitudinal direction; and, a retaining device secured on said receiver wall, said retaining device including:

a mounting plate disposed along said side wall portion of said receiver wall; and, a retention pin oriented in said lateral direction and supported on said mounting plate for displacement in said lateral direction between:

a first pin position in which said retention pin extends through said elongated slot into engagement with said carrier passage of said bolt carrier of said bolt assembly such that said bolt assembly is retained in a substantially-fixed longitudinal position within said receiver chamber; and, a second pin position in which said retention pin is retracted from engagement with said carrier passage of said bolt carrier of said bolt assembly such that said bolt assembly is reciprocally displaceable within said receiver chamber in said longitudinal direction.

2. A firearm according to claim 1, wherein said elongated slot extends longitudinally from a forward slot end to a rearward slot end, and said retention pin is positioned toward said rearward slot end.

3. A firearm according to claim 2, wherein said mounting plate is secured along said side wall portion of said receiver wall adjacent said rearward slot end of said elongated slot.

4. A firearm according to claim 1, wherein said firearm includes a midline extending in said longitudinal direction, said side wall portion of said receiver wall is a first side wall portion, said elongated slot is a first elongated slot disposed along said first side wall portion, said receiver wall includes a second side wall portion facing opposite said first side wall portion with said receiver chamber at least partially disposed therebetween, said second side wall portion includes a second elongated slot oriented longitudinally therealong and extending therethrough such that said elongated slot is in communication with said receiver chamber, and said mounting plate is adapted for securement on said receiver wall along either of said first and second side wall portions.

5. A firearm according to claim 4, wherein said receiver wall includes a first securement device disposed along said first side wall portion and a second securement device disposed along said second side wall portion, said mounting plate includes a securement passage extending therethrough dimensioned to at least approximately align with said first securement device with said retention pin positioned to extend through said first elongated slot when secured along said first side wall portion of said receiver wall and to at least approximately align with said second securement device with said retention pin positioned to extend through said second elongated slot when secured along said second side wall portion of said receiver wall.

6. A firearm according to claim 1, wherein said bolt assembly reciprocates between a closed bolt position disposed toward said forward end of said receiver and an open bolt position disposed toward said rearward end of said receiver, and said retention pin engages and retains said bolt assembly in said open bolt position.

7. A firearm according to claim 1, wherein in said second pin position said retention pin is at least partially disposed within said elongated slot of said side wall portion of said receiver wall.

8. A firearm according to claim 1, wherein said bolt assembly includes a firing pin supported on said bolt carrier.

9. A firearm according to claim 1, wherein said mounting plate includes a pin-receiving passage extending therethrough in said lateral direction, and said retention pin extends through said pin-receiving passage and is dimensioned for reciprocal displacement between said first and second pin positions through said mounting plate.

10. A retaining device securable along an associated firearm and selectively operable to engage and retain an associated bolt assembly of the associated firearm in a substantially-fixed position for an indeterminate period of time with the associated bolt assembly including an associated bolt carrier with an associated carrier passage, said retaining device comprising:

a mounting plate dimensioned for securement on an associated receiver of the associated firearm with the associated receiver including an associated receiver wall at an associated distance from the associated bolt assembly, said mounting plate having a thickness, a length and a width, said mounting plate including a first side surface portion and a second side surface portion facing opposite said first side surface portion with said first and second side surface portions spaced apart from one another in a thickness direction and said second side surface portion dimensioned to abuttingly engage the associated receiver, and said mounting plate including a pin-receiving passage extending therethrough in said thickness direction; and, a retention pin having a longitudinal axis and extending axially from a first end toward a second end, said retention pin extending through said pin-receiving passage such that said first end projects outwardly from said mounting plate beyond said first side surface portion, said retention pin supported on said mounting plate for axial displacement relative thereto between:

a first pin position in which said second end of said retention pin extends outwardly beyond said first side surface portion of said mounting plate a first distance in said thickness direction such that in said first pin position said second end of said retention pin is engageable with the associated carrier passage of the associated bolt carrier of the associated bolt assembly to retain the associated bolt assembly in a substantially-fixed position relative to the associated receiver; and, a second pin position in which said second end of said retention pin is disposed a second distance from said first side surface portion that is less than said first distance such that in said second pin position said second end of said retention pin is disengageable from the associated carrier passage of the associated bolt carrier of the associated bolt assembly.

11. A retaining device according to claim 10, wherein said second side surface portion is spaced a first thickness dimension from said first side surface portion, and said mounting plate includes a third side surface portion spaced from said second side surface portion in a direction opposite said first side surface portion, said third side surface portion facing opposite said first side surface portion and spaced a second thickness dimension from said first side surface portion that is greater than said first thickness dimension such that a shoulder surface portion extends between said second and third surface portions of said mounting plate.

12. A retaining device according to claim 10, wherein said mounting plate includes a first securement passage and a second securement passage with said first and second securement passages extending through said mounting plate in said thickness direction and spaced apart from one another in a lengthwise direction of said mounting plate.

13. A retaining device according to claim 12 further comprising a securement device dimensioned to extend through at least one of said first securement passage and said second securement passage.

14. A retaining device according to claim 10, wherein said mounting plate includes a mounting plate wall with a base wall portion and a projection wall portion, said base wall portion disposed between said first and second side surface portions, said projection wall portion extending from said base wall portion away from said second surface portion in said thickness direction toward an end surface portion with said pin-receiving passage extending through said base wall portion and said projection wall portion of said mounting plate wall.

15. A retaining device according to claim 10, wherein said pin-receiving passage is a first pin-receiving passage and said mounting plate includes a second pin-receiving passage extending therethrough with said second pin-receiving passage spaced from said first pin-receiving passage in a lengthwise direction.

16. A retaining device according to claim 15, wherein said mounting plate includes a mounting plate wall with a base wall portion and a projection wall portion, said base wall portion disposed between said first and second side surface portions, said projection wall portion extending from said base wall portion away from said second surface portion in said thickness direction toward an end surface portion with said first pin-receiving passage and said second pin-receiving passage extending through said base wall portion and said projection wall portion of said mounting plate wall.

17. A retaining device according to claim 10 further comprising an operator-actuation device secured on said first end of said retention pin, said operator-actuation device dimensioned for displacing said retention pin from said second pin position to said first pin position by an associated firearm operator.

18. A retaining device according to claim 17 further comprising a spring compressively disposed between said mounting plate and said operator-actuation device, said spring operative to urge said retaining pin toward said second position.

19. A retaining device according to claim 18, wherein at least one of said mounting plate and said operator-actuation device includes a spring seat dimensioned to receivingly engage at least a portion of said spring.

20. A retaining device securable along an associated firearm and selectively operable to engage and retain an associated bolt assembly of the associated firearm in a substantially-fixed position for an indeterminate period of time with the associated bolt assembly including an associated bolt carrier with an associated carrier passage, said retaining device comprising:

a mounting plate having a height, a width and a length, said mounting plate securable on an associated receiver wall of an associated receiver of the associated firearm in an orientation in which said length is alignable with a longitudinal direction of reciprocal motion of the associated bolt assembly, said width is alignable with a vertical direction of the bolt assembly, and said height is alignable with a lateral direction of the associated bolt assembly with the lateral direction oriented transverse to the longitudinal and vertical directions, said mounting plate including a mounting plate wall with a base wall portion and a projection wall portion, said base wall portion including a first side surface portion and a second side surface portion spaced apart from said first side surface portion in a heightwise direction, said projection wall portion extending from said base wall portion in said heightwise direction toward an end surface portion, said mounting plate including first and second pin-receiving passages extending in said heightwise direction through said base wall portion and said projection wall portion of said mounting plate wall with said second pin-receiving passage spaced from said first pin-receiving passage in a widthwise direction, and a securement passage extending in said heightwise direction through said base wall portion with said securement passage spaced from said first and second pin-receiving passages in a lengthwise direction;

a retention pin having a longitudinal axis and extending axially from a first end toward a second end, said retention pin extending through one of said first and second pin-receiving passages such that said first end projects outwardly from said mounting plate beyond said end surface portion, said retention pin slidably supported on said mounting plate for axial displacement in said heightwise direction relative thereto;

a securement device extending through said securement passage and dimensioned for engagement with the associated receiver;

an operator-actuation device secured on said first end of said retention pin; and, a spring compressively disposed between said mounting plate and said operator-actuation device;

said operator-actuation device and said spring cooperative to provide for axial displacement of said retention pin between:

a first pin position in which said second end of said retention pin extends outwardly beyond said first side surface portion of said mounting plate a first distance such that in said first pin position said second end of said retention pin is engageable with the associated carrier passage of the associated bolt carrier of the associated bolt assembly to retain the associated bolt assembly in a substantially-fixed position relative to the associated receiver; and, a second pin position in which said second end of said retention pin is disposed a second distance from said first side surface portion that is less than said first distance such that in said second pin position said second end of said retention pin is disengageable from the associated carrier passage of the associated bolt carrier of the associated bolt assembly.

* * * * *